United States Patent [19]

Poole

[11] 4,301,583

[45] Nov. 24, 1981

[54] FLUID METERING ROLLER

[75] Inventor: Johnnie L. Poole, Charlotte, N.C.

[73] Assignee: Consolidated Engravers Corporation, Charlotte, N.C.

[21] Appl. No.: 12,468

[22] Filed: Feb. 15, 1979

[51] Int. Cl.[3] ..... B30B 3/00

[52] U.S. Cl. ..... 29/121.2; 29/121.4; 29/121.5; 101/150; 101/348

[58] Field of Search ..... 29/121.4, 121.6, 121.1, 29/121.2, 121.3, 121.8, 121.5; 101/150, 153, 348, 170; 118/212, DIG. 15

[56] References Cited

U.S. PATENT DOCUMENTS

| | | | |
|---|---|---|---|
| 2,322,530 | 6/1943 | MacArthur | 101/401.1 |
| 2,380,047 | 7/1945 | Hyman | 427/258 |
| 2,393,529 | 1/1946 | Harrigan | 29/121.2 |
| 3,089,415 | 5/1963 | Grenbecki et al. | 29/121.4 |
| 3,613,570 | 10/1971 | Heurich | 101/350 |
| 4,009,658 | 3/1977 | Heurich | 101/348 |
| 4,016,811 | 4/1977 | Zavodny | 101/148 |
| 4,155,766 | 5/1979 | Hieber et al. | 29/121.2 |

OTHER PUBLICATIONS

"New Cellular Construction Passes Performance Test"; Leaflet Consolidate Group, Inc., North Carolina; 8-1980.

*Primary Examiner*—S. Leon Bashore
*Assistant Examiner*—Steve Alvo
*Attorney, Agent, or Firm*—Richards, Shefte & Pinckney

[57] ABSTRACT

A fluid metering or anilox roller whose surface is generally covered by spaced fluid retention cells and channels connecting serially adjacent cells in staggered adjacent series of cells extending around the roller, the channels being narrower than the cells.

3 Claims, 4 Drawing Figures

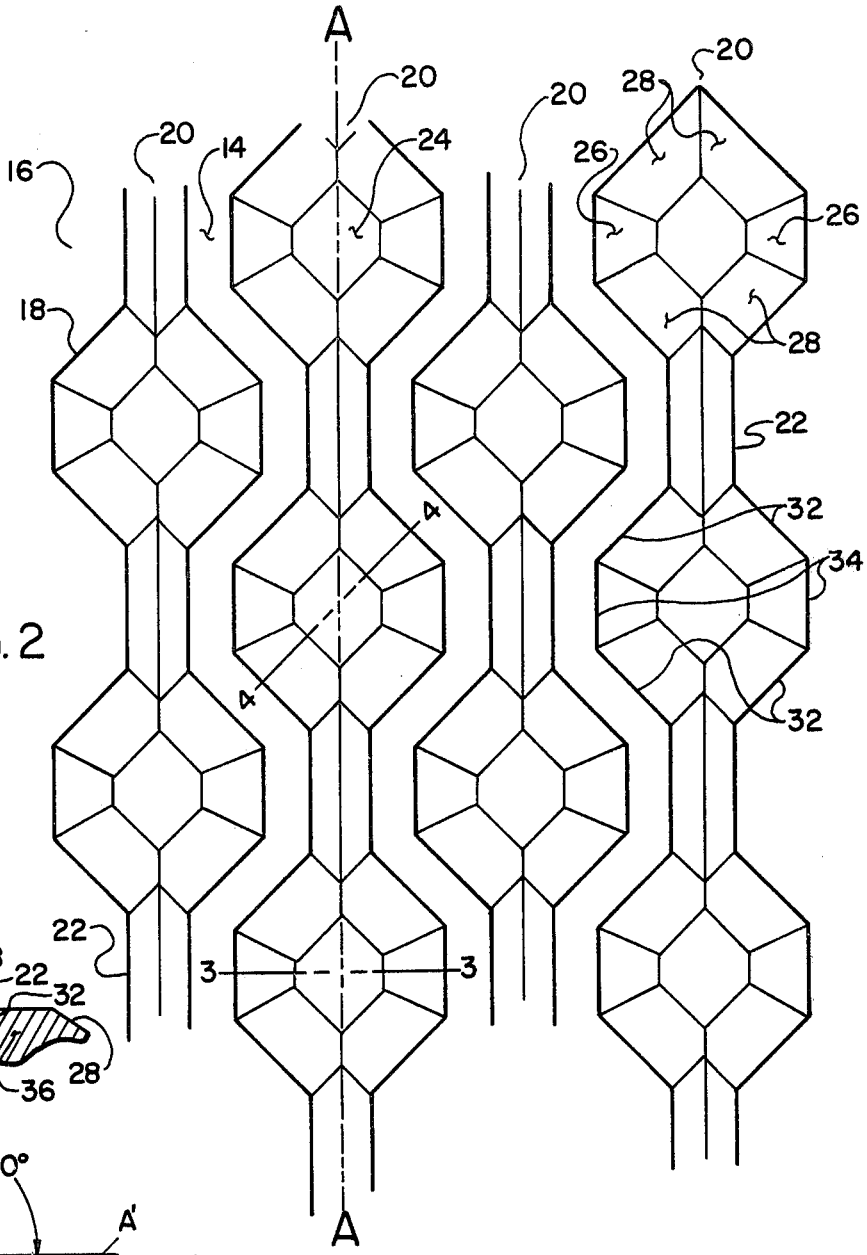
FIG. 2
FIG. 4
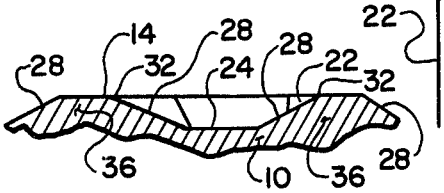
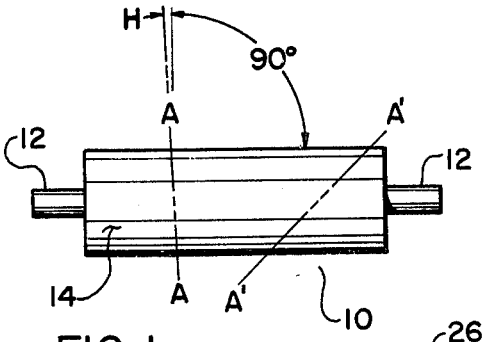
FIG. 1
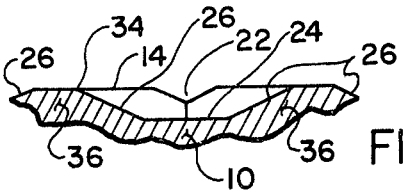
FIG. 3

FLUID METERING ROLLER

BACKGROUND OF THE INVENTION

Fluid metering or transfer rollers, commonly called "anilox rollers," are used extensively in the flexographic printing trade to transfer closely controlled quantities of ink from rubber fountain rollers running in an ink bath to a rubber printing plate roller or cylinder. In turn, the plate cylinder transfers the ink picked up from the anilox roller to a web of material, usually plastic, being printed. The circumferential surfaces of anilox rollers have been engraved with a variety of tiny, closely spaced, shallow depressions called "cells", and the cells retain ink therein when doctor blades scrape the polished surfaces of the rollers otherwise clean of ink.

The most common cells are known as (a) pyramidal, in which the depressions take the shape of inverted four-sided pyramids; (b) quadrangular, in which the depressions take the shape of inverted truncated four-sided pyramids; and (c) tri-helical, in which the depressions are shallow V-grooves extending helically around the circumferential surface of a roller. The pyramidal and quadrangular cells are typically engraved in 45° helical series relative to the roll, criss-crossing to form a diamond pattern of cells. Other shapes and dispositions of cells on the surfaces of anilox rollers (and on other similar rollers used for various coating and printing purposes) have been advanced for various purposes, and U.S. Pat. Nos. 3,613,578, 2,322,530, 4,016,811, 2,393,529, 2,380,047, and 4,009,658 disclose a variety of shapes of cells arranged to form a variety of patterns.

Several problems have existed with previously known anilox rollers, such as (a) moiré effects on the web being printed where a regular pattern on the roller falls into some semi-register with a texture pattern of the web, (b) lack of even ink distribution on the web where the ink must bleed across long straight uninked bare streaks or tracks between the ink deposits from the cells, and (c) ink drying and caking in the cells if the cells are deep and irregular enough to reliably hold a full supply of ink when doctor-bladed.

Channel-connected cells, as provided by the present invention, avoid moiré effects on the printed web, cause better migration and distribution of ink on the web for evenness of appearance, and are constantly supplied with and reliably hold full supplies of fresh ink when doctor-bladed, to the end that anilox rollers with the channel-connected cells transfer ink with an improved quality, quantity, and consistency not to be found with conventional anilox rollers.

SUMMARY OF THE INVENTION

Briefly described, the liquid transfer roller of the present invention has spaced cells generally covering its surface and has channels on the surface connecting serially adjacent cells of series of the cells which extend around the roller, and the channels are substantially narrower than the cells.

The present embodiment of the invention has cells which are substantially deeper than the channels, and has adjacent series of the cells wherein the cells are in staggered relation to form an internested pattern of cells.

Preferably the channels have a depth of the order of one-third to two-thirds the depth of the cells, and the cells have boundary lines which are disposed on the roller surface at substantial angles to imaginary perpendiculars to the series of cells passing across the cells on the roller surface. The tops of the walls between the adjacent series of cells have portions alternately extended toward one side and then the other and connected by portions disposed generally parallel to the adjacent series of cells extending around the roller.

In the preferred embodiment of the present invention, the connected series of cells extending around the roller are disposed helically on the surface thereof.

BRIEF DESCRIPTION OF THE DRAWINGS

FIG. 1 is a lateral view of a transfer or anilox roller;

FIG. 2 is a highly enlarged view of a small portion on the surface of an anilox roller having channel-connected cells according to the present invention;

FIG. 3 is a cross-sectional view of a portion at the surface of the roller as taken along the line 3—3 of FIG. 2; and FIG. 4 is a cross-sectional view of a portion at the surface of the roller as taken along the line 4—4 of FIG. 2.

DESCRIPTION OF THE PREFERRED EMBODIMENT

A preferred embodiment of a fluid metering, liquid transfer, or anilox roller according to the present invention takes the form of a cylindrical steel roller 10 having shafts 12 projecting from both ends thereof concentrically with the smoothly finished roller surface 14. The surface 14 has knurled therein a covering pattern 16 of tiny depressions or cells 18 which are connected together, in series 20 extending around the cylindrical surface 14 of the roller 10, by similarly knurled-in channels 22 which are narrower and shallower than the aforesaid cells.

The connected cell series 20 are typically disposed in the form of a helix on the cylindrical surface 14 of the roller 10 in a pattern having 200 cells 18, "lines", or series 20 of cells per inch in a direction transverse to the helix along the surface 14 of the roller 10, and similarly 200 cells or lines per inch along the helix, a spacing of 125 microns or 0.005 inch in each direction. The helix angle may be very small or as much as 45° or more as indicated by the lines A—A and A'-A' of FIG. 1 which represent possibilities for the angular disposition of the centerline or axis of a series 20 of cells. The centerline or axis of a series 20 of cells is illustrated by the broken line A—A of FIG. 2. Typically, six series 20 of cells spiral helically around a roller 10 together, with the cells 18 in adjacent series 20 staggered and internested in relation to each other, forming a "six-thread lead," so to speak, having a very small helix angle H, as illustrated at the left of FIG. 1 (not to scale). Since the diameter of a roller 10 may typically lie in the range of 2inches to 26 inches, and the lead of such a 200-line per inch six-thread lead would be only 0.005 inch$\times$6=0.030 inch, such a series 20 of cells 18 extending once around the roller 10 would lie generally circumferentially on the surface 14 of the roller.

A typical cell 18, as best illustrated in FIG. 2, has a flat bottom surface 24 disposed below and generally parallel to the roller surface 14. The surface 24 has a non-equi-angular hexagonal shape in plan view as in FIG. 2 and side and end ramp surfaces 26 and 28 respectively slope upwardly to the roller surface 14 from the bottom surface 24 as best seen in FIGS. 3 and 4. The ramp surfaces 26 and 28 all slope upwardly at generally the same angles relative to the roller surface 14 so that the boundary (formed by the intersections of the ramp surfaces 26 and 28 and the roller surface 14) of a cell 18 has an enlarged shape geometrically similar to that of the bottom surface 24 of the cell, and the end boundary lines 32 may typically be disposed at substantial angles (approximately 45° in FIG. 2) to the axis or center line A—A while the side boundary lines 34 are generally parallel to the axis A—A, all the boundary lines 32 and 34 typically being disposed at substantial angles to imaginary perpendiculars to the series 20 of cells passing across the cells on the surface 14. The depth of a cell 18 from the roller surface 14 to the flat bottom surface 24 thereof may typically be 20 microns or 0.0008 inches, the width between side boundary lines 34 may be about 150 microns or 0.006 inches, and the width of the bottom surface 24 may be about 60–65 microns or 0.0025 inches. The channels 22 may typically be 42 microns or about 0.0017 inch wide and about 10 microns deep with a shallow V-shape, leaving about a 30 micron width of the roller surface 14 standing between adjacent side boundary lines 34 and channels 22 as the top of a wall 36 disposed between adjacent series 20 of cells 18. The length of the cells 18 axially of the series 20 may be suitably chosen so that the top of the wall 36 is continued with generally uniform width between the adjacent end boundary lines 32 of the adjacent staggered cells 18 in the adjacent series 20, alternately extending toward one side and then the other therebetween, the alternately extending portions of the top of the wall 36 being connected by the portions of the top of the wall 36 standing between the side boundary lines 34 and the channels 22 and extending generally parallel to the series 20 of the cells 18. The tops of the walls 36 thereby extend continuously zigzagging between adjacent series 20 of the cells 18.

During manufacture of a roller 10, the roller surface 14 is first smoothly and truly cylindrically finished, then the pattern of cells and connecting channels is knurled into the surface 14, after which the surface 14 is refinished truly cylindrically, thereby removing any irregularities which may have been pushed up on the surface by the knurling.

In operation, the roller 10 is rotated partially submerged in a liquid ink bath, or against a rubber roller partially immersed therein, thereby covering the roller surface 14 and filling the cells 18 with ink. A doctor blade (not shown) conventionally scrapes the excess ink from the surface 14, leaving the cells 18 filled with ink. The doctor blade rides on the tops of the walls 36 which in minute zigzags typically generally spiral helically around the roller 10, so that any wear on the doctor blade is spread uniformly along its length. The puddle of fresh liquid ink formed from the ink scraped from the surface 14 forms turbulent roiling currents which continually flush out the cells 18 and channels 22, since the channels form unobstructed paths between the cells 18 of each cell series 20 and allow the fresh ink to be jetted along the channels 22 and into and through the cells 18. While the generally sharp corners at the intersections of the ramp surfaces 26 and 28 with the bottom surface 24, and with each other, tend to advantageously hold ink during the doctor blading, they also tend to hold residual quantities after the bulk of the ink has been transferred to a rubber printing plate cylinder (not shown)—such residual quantities tend to dry and cake in the cells, but the constant flushing action with the connected cells 18 of the present invention advantageously prevents any stagnation of ink in the cells as would happen in conventional un-connected cells. The aforementioned 45° angling of the end boundary lines 32 of the cells 18 tend to promote the free flow and flushing of the ink through the cells.

Channel-connected cells, as provided by the present invention, avoid moiré effects, presumably because the zig-zag walls between adjacent staggered series of connected cells cause no straight and unbroken uninked lines or streaks on the printed web. The channel-connected cells also appear to cause better ink distribution on the web, again because the zig-zag uninked tracks left on the web by the zig-zag walls between adjacent series of connected cells appear to be more susceptible to ink migration, or bleeding, thereacross than the straight uninked lines or tracks of the conventional anilox roller cell patterns. The channel-connected cells may be provided with the depth and irregularities necessary to reliably hold a full supply of ink when doctored, but drying and caking of the ink in the cells is no problem because the cells are flushed out at each roller revolution by a turbulent puddle of fresh ink collected ahead of the doctor blade which is jetted through each channel into each following cell, filling it, and then out through the following channel into the next cell in the series. Thus the channel-connected anilox roller cells of the present invention provide a quality, quantity, and consistency of ink transfer believed to be unequalled by conventional anilox rollers.

While the configuration of the cells 18 and channels 22 as disclosed in the drawings herewith are advantageous from the standpoints of flushing out the cells and breaking up any continuous wall lines between cells which might show up in moiré patterns on the web or substrate being printed, it is to be understood that the cells might take many other basic shapes such as circular, square, unsymmetrical, or otherwise as desirable to break up moiré patterns yet be internesting, and might have round, pointed, or other bottoms; and the channels might likewise have other forms and dispositions, for example, they might be skewed from parallelism with the series 20 of cells or have rounded bottoms. Since the cells 18 have a particular function of covering as much of the roller surface 14 as practical, leaving only enough of surface 14 for doctor blade support, while the channels 22 should connect the cells for flushing purposes and have substantial depth therefor, the cell and channel sizes, dimensions, spacings, configurations, and dispositions shown in the accompanying drawings and described in this specification as examples are not to be construed as limiting the scope of this invention, which is only to be determined by the scope of the appended claims.

I claim:

1. A liquid transfer roller having spaced cells depressed into the surface thereof, said cells being arranged in series of said cells extending generally circumferentially around said roller, and channels depressed into the surface of said roller connecting serially adjacent cells of each said series of said cells, said channels being substantially narrower than said cells and forming unobstructed paths between said adjacent cells allowing liquid to be jetted along the channels into and through the cells, adjacent series of said cells and their connecting channels extending around said roller wherein said cells in said adjacent series are in staggered relation to form an internested pattern of said cells having continuous walls between said adjacent series of said cells and channels, said cells, channels and walls covering the useful surface of said roller, said walls having tops which form the outer surface of the roller, and the tops of the walls between said adjacent series of said cells and channels having portions alternately extended laterally of said series toward one side and then the other and connected by other portions of the tops of the walls disposed in the general direction of said adjacent series of said cells and channels extending around said roller with the continuous surface of said tops of generally uniform width throughout their extent around said roller.

2. A liquid transfer roller according to claim 1 wherein said cells are substantially deeper than said channels.

3. A liquid transfer roller according to claim 1 or 2 wherein said cells have end boundary lines disposed on the roller surface at angles of approximately 45° to imaginary perpendiculars to said series of said cells passing across said cells on the roller surface.

* * * * *